United States Patent [19]

Collins et al.

[11] Patent Number: 4,565,184

[45] Date of Patent: Jan. 21, 1986

[54] COMBUSTIBLE PARTICULATE FUEL HEATER

[76] Inventors: Bruce H. Collins, 11426 Gravelly Lake Dr., Tacoma, Wash. 98499; Heinrich J. W. Jurgens, 30919 Meridian East, Graham, Wash. 98338

[21] Appl. No.: 611,349

[22] Filed: May 17, 1984

[51] Int. Cl.[4] ..... F24B 9/00; F24H 9/18; F23K 3/14

[52] U.S. Cl. ..... 126/368; 126/107; 126/112; 126/73; 126/68; 126/77; 110/110; 122/46

[58] Field of Search ..... 126/74, 73, 367, 368, 126/107, 101, 112, 99 R, 7, 10, 11, 68, 34, 83, 77; 110/110; 122/46, 212 F

[56] References Cited

U.S. PATENT DOCUMENTS

| | | | |
|---|---|---|---|
| 1,139,857 | 5/1915 | Garey | 126/74 |
| 2,014,171 | 9/1935 | Fischel | 122/212 F |
| 2,067,583 | 1/1937 | Stark | 110/101 R |
| 2,315,070 | 3/1943 | McNaughton | 126/107 X |
| 2,584,235 | 2/1952 | Skelly | 110/110 X |
| 2,689,560 | 9/1954 | Johnson | 126/101 |
| 4,261,326 | 4/1981 | Ihlenfield | 126/110 R |
| 4,351,315 | 9/1982 | Babbage | 126/73 |

FOREIGN PATENT DOCUMENTS

| | | | |
|---|---|---|---|
| 46339 | 5/1888 | Fed. Rep. of Germany | 126/74 |
| 1076708 | 10/1954 | France | 126/107 |

*Primary Examiner*—Randall L. Green

*Attorney, Agent, or Firm*—Wells, St. John & Roberts

[57] ABSTRACT

A heater is disclosed for burning combustible particulate fuels. The fuels are delivered to an internal retort at a constant rate. They are burned at an open end of the retort with the aid of a primary air supply manifold that surrounds the open end of the retort and directs primary combustion air into the particulates at the open retort end. Secondary combustion air is directed through an annular air supply manifold situated above the open retort end. The hot exhaust gases pass upwardly through a combustion chamber and subsequently downwardly through an exhaust gas plenum to an exhaust gas discharge. Flow of the combustion air and exhaust gases is induced by a vacuum blower mechanism by which a reduced pressure is produced within the combustion chamber to draw air through the primary and secondary air supply manifolds. The exhaust gases drawn off by the vacuum mechanism are pressurized on a discharge side of the vacuum mechanism. A heat exchanger can be provided in close proximity to the combustion chamber and exhaust gas plenum to receive heat generated thereby and to transmit it to useful areas within the surrounding structure. The heat exchanger may also be utilized as an insulator between the hot surfaces of the exhaust plenum and a fuel hopper which may be supplied as an integral part of the heater.

13 Claims, 5 Drawing Figures

FIG 4
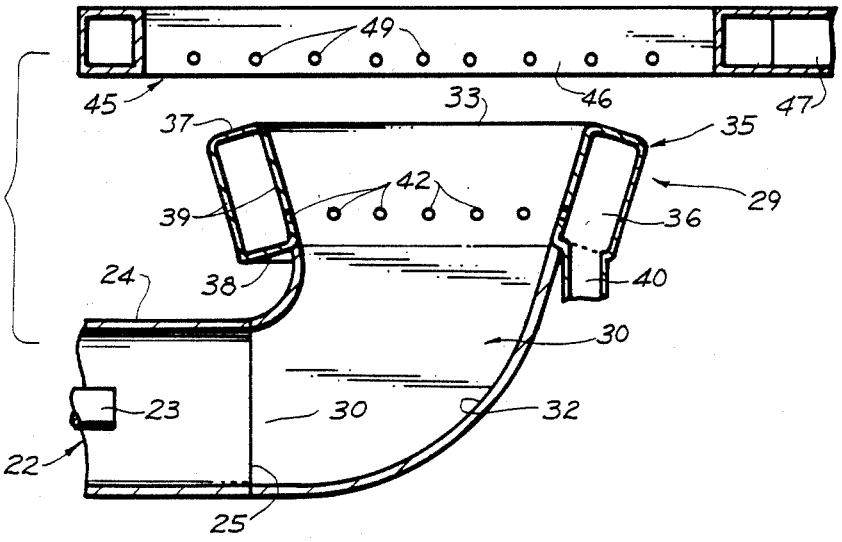
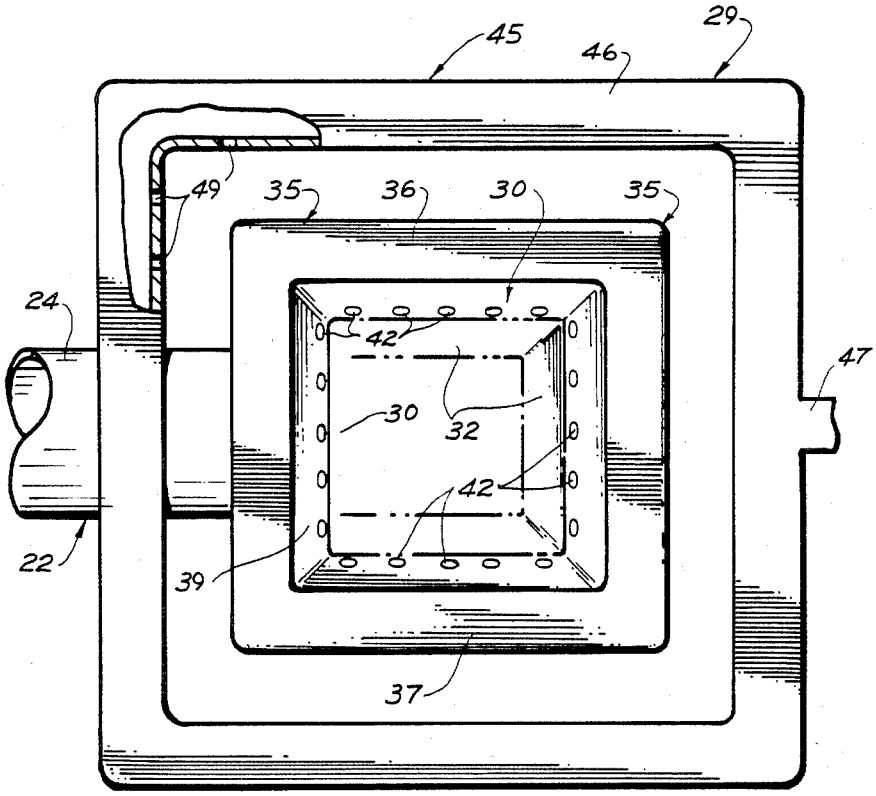
FIG 5

COMBUSTIBLE PARTICULATE FUEL HEATER

TECHNICAL FIELD OF THE INVENTION

The present invention relates to heating by combustion of particulate fuels.

BACKGROUND OF THE INVENTION

Much effort has been expended in developing alternate heating sources due to the ever escalating costs of energy and availability of fuel or electricity for heating purposes. Many different forms of wood stoves, for example, have been developed in recent years as alternate heat sources. But, wood fired heaters have yet been able to attain any consistent degree of thermal efficiency. Furthermore, control of temperature is difficult in such heaters as such control is dependent upon the nature of the fuel being burned and many other conditions that are not easily controlled.

A partial solution has been found in the development of pelletized fuel. Organic "bio-mass" materials are processed and formed into small solid pellets. These can be fed by mechanical means at a metered rate into a burner. Control of the feed rate has proven to facilitate greater control of the burning temperatures. Increased efficiency has also been attainable. However, there has still remained much room for improved performance.

Control of combustion air through a burner has long been a troublesome area. This is due at least in part to dependence upon convection air currents and pressure differential between the building interior and outside ambient air. Wind, for example, can have a substantial affect on the amount of combustion air being drawn into a stove or burner from within an associated building. The lack of ability to precisely control the amount of combustion air entering a burner has hampered efforts to achieve greater burning efficiency, even with modern forms of burners using pelletized fuel.

It has therefore become increasingly desirable to obtain some form of heater that will operate efficiently and effectively to completely burn the fuel within. This is desirable not only to obtain the maximum thermal value from the material being burned, but also to reduce the amount of pollutants exhausted from the burner.

BRIEF DESCRIPTION OF THE DRAWINGS

The invention is illustrated in the accompanying drawings, in which:

FIG. 4 is an enlarged view of a burner used with the present invention; and

FIG. 5 is a plan view of the complete burner with portions thereof broken away.

DETAILED DESCRIPTION OF THE PREFERRED EMBODIMENT

Figure 1:
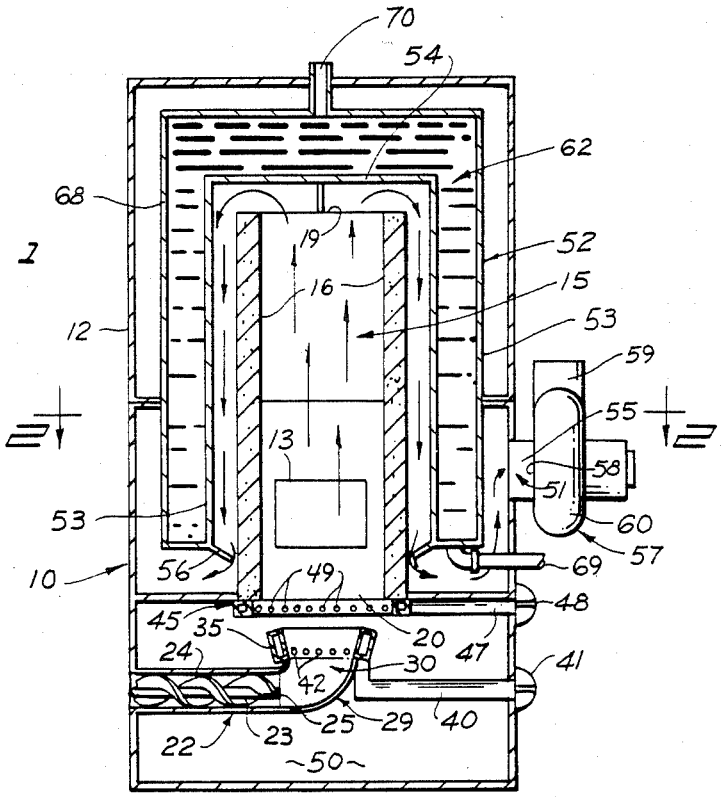
FIG. 1 is a sectional view of a heater embodying principle components of the present invention.

In compliance with the constitutional purpose of the Patent Laws "to promote the progress of science and useful arts" (Article 1, Section 8), applicant submits the following disclosure of the invention.

The present heater as illustrated in the drawings and described more completely below is intended for use primarily with particulate fuels. The term "particulate fuel" as used herein may be taken broadly to mean any form of combustible solid material formed in discrete, individual units. A good example of such particulate fuel is "pelletized" organic materials, sawdust, coal, or wood chips.

Figure 3:
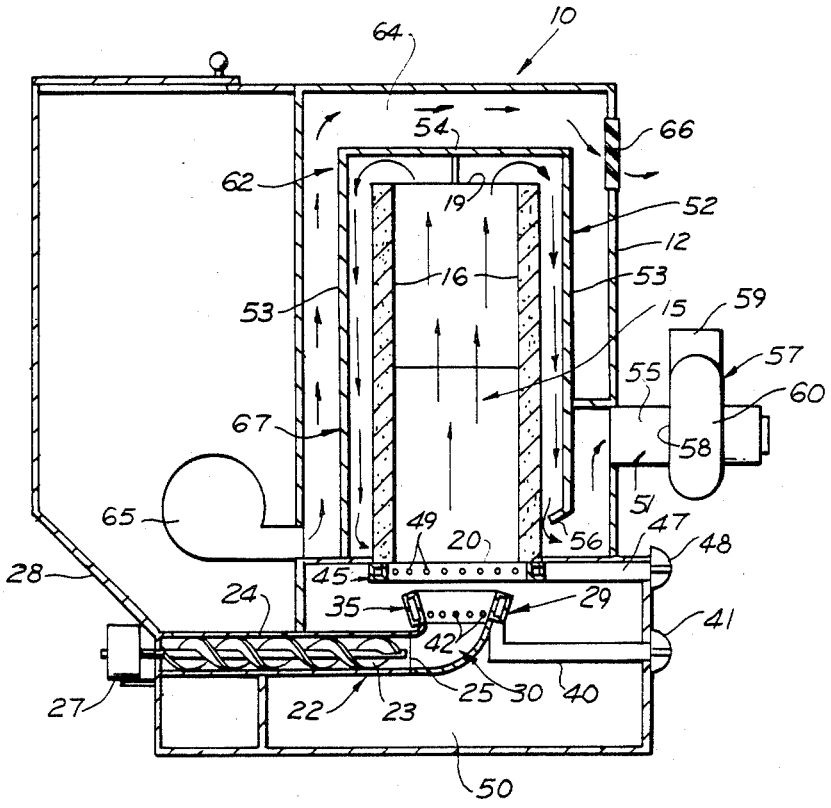
FIG. 3 is a sectioned view of the present heater using an air heat exchanger.

There are two related forms of the present invention illustrated in the accompanying drawings. FIG. 1 is illustrative of a form for the present heater using hydronic heat exchange principles. FIG. 3 is illustrative of a form for the present invention using a convection air type heat exchanger. Both forms make use of basic principles common to the present invention. The following description will suffice for both with the exception of individual elements that are unique to the particular forms described below.

The heater shown in the present drawings is designated therein by the reference numeral 10. It can be produced as a simple auxiliary heater for residential purposes or can be, on a larger scale, used as a primary heat source for large buildings. The scale of the heater can therefore vary considerably with its intended use.

The basic heater 10 includes an airtight enclosure 12. An appropriate access door 13 (FIG. 1) may be formed through the enclosure to allow physical access to the heater interior.

Figure 2:
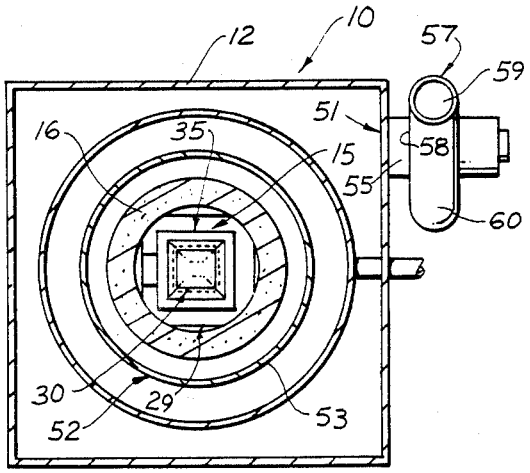
FIG. 2 is a sectional view through the heater taken substantially along a line 2—2 in FIG. 1.

A combustion chamber 15 is disposed within the airtight enclosure 12. It is formed by substantially upright side walls 16 formed of firebrick or other appropriate refractory material. The upright walls 16 define an upright tubular configuration that may be circular as indicated in FIG. 2. The walls 16 extend from an open top end 19 of the chamber to a bottom end 20.

Fuel is delivered into the airtight enclosure toward the bottom combustion chamber end by a feed conveyor means 22. The feed conveyor means 22 may be comprised of a substantially horizontal auger 23 for feeding material along the length of an auger tube 24. The tube 24 includes a discharge end 25 situated within the airtight enclosure and adjacent the bottom combustion chamber end 20.

The auger 23 is preferably powered by a metered drive 27 (FIG. 3) to supply a metered supply of fuel to the combustion chamber area. The drive can be selectively controlled to match the burn rate (temperature) of the material delivered into the combustion chamber.

A hopper 28 as shown in FIG. 3 can be supplied along with the heater or can be mounted at a remote location, depending upon the length and feed capability of the fuel feed conveyor means 22. Heaters 10 supplied with integral hoppers will include insulation means 67 (described below) between the hopper 28 and heater preferably in the form of an air space to prevent overheating of the hopper contents.

A burner 29 is situated within the airtight enclosure 12 at the bottom combustion chamber end 20. The burner 29 is used to receive combustible particulate material from the conveyor feed 22 and to support the material during the combustion process.

The burner 29 includes a substantially upright retort 30 having a lower particulate fuel receiving end 31. Upwardly diverging walls 32 lead to an open upper retort end 33. The lower particulate receiving end is connected directly to the discharge end 25 of auger tube 24. Augered material will therefore be received and directed upwardly along the diverging walls 32 toward the open upper retort end 33. Combustion of the material occurs adjacent to the open upper retort end.

Combustion of particulate fuel at the open upper end of the retort is enhanced by provision of a primary combustion air supply means 35. This is shown generally in FIGS. 1 and 3 and in more substantial detail by FIGS. 4 and 5. The primary combustion air supply means 35 includes a primary combustion air supply manifold 36 extending at least partially about the open upper end of the retort. Manifold 36 is open to the ambient atmosphere outside the enclosure 12 in order to selectively deliver primary combustion air to the retort and combustion chamber.

The manifold 36 includes a top peripheral edge 37 and a downwardly spaced bottom edge 38. These edges are joined by substantially upright side walls 39. Together, edges 37, 38, and side walls 39 define a peripheral air passage about the manifold for receiving air supplied through a delivery tube 40.

The delivery tube 40 leads from open communication with the interior of manifold 36 to the ambient air outside the airtight enclosure 12. A draft control 41 is provided at the outward open end of delivery tube 40 for selectively controlling the amount of air allowed to enter.

The bottom manifold edge 38 may be affixed to the top end of the retort such that the inside walls become coextensive with the diverging retort walls 32. The manifold thus becomes an integral part of the retort and the upper or top peripheral edge 37 becomes the open upper retort end 33.

Air entering through the delivery tube 40 is allowed to pass into the retort through discharge openings 42. Air enters through the openings 42 and into particulate material adjacent to the upper open end of the retort to support primary combustion. The openings 42 are preferably formed about the entire inside perimeter of the manifold to face one another across the open upper retort end 33. It is also preferable that the discharge openings be situated toward the bottom manifold edge 38 as clearly shown in FIG. 4. This positioning facilitates complete entry of air to support combustion of particulates within the retort, yet above the discharge openings. This facilitates even and thorough combustion of the fuel particulates and avoids "backfire" of the particulates downwardly through the retort and toward the auger feed tube 24.

A secondary combustion air supply means is shown at 45. It includes a manifold 46 that is similar in configuration to the primary combustion air manifold 36. Manifold 46 is spaced above the retort and encompasses an air space substantially centered over the retort opening. Air is supplied to the secondary combustion air supply manifold 46 through a secondary air delivery tube 47. Tube 47 leads from open communication with the manifold 46 to ambient air outside the airtight enclosure 12. A draft control 48 is provided at the outside open end of the tube to facilitate selective control of the amount of air entering into the secondary manifold 46.

The secondary manifold 46 is provided with a plurality of discharge openings 49 that face one another across the area encompassed thereby. Air delivered through these openings 49 is directed into the combustion area to permit a controlled secondary burn of gases and particles released by primary combustion at the retort.

The secondary burn is instrumental in reducing exhaust particulates and carbon monoxide levels. The result is a marked absence of visible smoke with the exhaust gas when the draft controls and other systems are correctly controlled. This capability permits compliance with very rigid air quality standards and contributes to a very high net efficiency of thermal conversion of the burning fuel.

An ash pit 50 is situated below the retort 30. The ash pit will receive ashes from burned particulates that spill over the upper manifold edge 37 in response to reception of incoming fresh fuel supplied by the auger 23. Experimentation has shown, however, that very little ash is developed due to nearly complete gasification and combustion of the fuel at the retort.

Hot exhaust gases pass from the area of primary and secondary combustion from the bottom combustion chamber end 20 over the top end 19 and into an exhaust and heat exchange plenum 52. The exhaust gases are delivered through the exhaust and heat exchange plenum 52 to an exhaust duct 51 that leads outwardly of the airtight enclosure.

The exhaust and heat exchange plenum 52 may be comprised of upright walls 53 spaced outwardly from the combustion chamber 15 and leading to a closed top end 54. The top end 54 is spaced upwardly of the open combustion chamber top end 19 to transmit heat to the heat exchange medium and to facilitate passage of exhaust gases from over the combustion chamber and downwardly into the space between the combustion chamber walls 16 and exhaust and heat exchange plenum walls 53.

The discharge duct 55 opens into the area between walls 52 and combustion chamber 15 at an elevation preferably below the top end 19 of the combustion chamber. This positioning is desirable to induce a tortuous flow path for the exhaust gases. They first move upwardly through the combustion chamber, then downwardly outside the chamber walls 16 before they are permitted to be drawn from the airtight enclosure. This facilitates substantial cooling of the exhaust gases before they leave the airtight enclosure.

The exhaust duct 51 is connected to a vacuum means 57 which represents a very important consideration in the present invention. The vacuum means 57 is provided to produce a constant, controlled pressure differential between the area confined by the airtight enclosure and the outside, ambient atmosphere. Ambient air will thus be drawn at a preselected rate through at least one of the combustion air supplies 35,45 to support combustion at the retort and to facilitate movement of exhaust gases through the combustion chamber, exhaust plenum, and finally out to the atmosphere through the exhaust duct 51. Operation of vacuum means 57 is not affected by outside weather conditions (such as wind) and so can be relied on to maintain a constant controlled airflow through the heater. This added control greatly enhances overall efficiency of the heater.

The vacuum means may be comprised of a powered suction blower 60 having its intake 58 connected directly to the discharge duct 55 and a discharge 59 connected to a standard flue or chimney (not shown).

Operation of the vacuum means 57 influences the performance, high efficiency, and inherent safety of the present invention. A constant controlled partial vacuum (low pressure) is formed within the combustion chamber by the exhaust blower drawing hot gases from the exhaust gas plenum. The exhaust gas is then pressurized on the discharge side of the blower and is forced to exit to an area outside the associated building. This eliminates the need for a costly chimney or stove pipe which is necessitated with typical home wood burning furnaces and stoves.

The partial vacuum induced in the combustion chamber 15 by the vacuum means 57 induces gasification of the particulate fuels at a higher level than would be achieved at ambient pressure.

A heat exchanger 62 may be provided about the exhaust plenum 52 within the airtight enclosure 12. Two basic forms of heat exchangers 62 may be utilized easily with the present heater. FIG. 1 shows a hydronic form of the heat exchanger 62 while FIG. 3 illustrates a convection air heat exchanger system. Both forms receive heat from the exhaust plenum and combustion chamber and convey the heat to areas within the surrounding structure as required.

With the form illustrated in FIG. 3, a portion of an air plenum 64 is used as an insulation means 67 to protect the hopper 28. Means 67 may include an integral air space within the heat exchanger between the hopper 28 and hot surfaces of the exhaust plenum walls. This air space within the heat exchanger will prevent overheating of the hopper contents due to the cooling nature of the air passing through.

The air plenum 64 includes a blower 65 for supplying cool ambient air in a forced stream over the surfaces of the exhaust plenum walls 53 exposed within the enclosure 12. The blower forces air into the plenum 64 at a location below the closed top end of the exhaust plenum. The forced air moves about the plenum walls 53 and over the top end 54 to finally exit through a discharge 66 adjacent the top of the enclosure.

The blower is situated directly adjacent to the hopper so the coolest air will pass immediately through the plenum airspace between the hopper and adjacent exhaust plenum walls 53. This further assures thermal insulation of the hopper while allowing its positioning in close proximity to the exhaust plenum and combustion chamber. Heater units supplied with an integral hopper may therefore be constructed in a relatively compact configuration. Of course, the hopper can be detached from the unit in furnace models and spaced at any convenient location within the capability of the feed conveyor means 22.

A water jacket heat exchanger 68 is diagrammatically shown in FIG. 1. The water jacket resembles the convection air exchanger, including a relatively low water inlet 69 and an elevated outlet 20. Water or other appropriate fluid may enter through the cold inlet 69 for heating through the walls of the exhaust plenum 52. The heated fluid may then be discharged through the outlet 70 to be stored or circulated through subsequent conventional heat exchange devices such as radiators, heat exchange coils, etc.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A combustible particulate fired heater, comprising:

a combustion chamber defined by upright side walls extending between open top and bottom ends;

an enclosure surrounding the combustion chamber;

a retort within the combustion chamber adjacent the bottom end thereof and having a lower particulate receiving end and an upper open end;

feed conveyor means leading through the enclosure to the retort for delivering metered quantities of combustible particulates to the lower particulate receiving end of the retort;

primary combustion air supply means having a primary combustion air supply manifold extending at least partially about the upper open end of the retort;

primary air control means on the primary air supply means for selectively allowing entry of combustion air from outside the enclosure into the retort;

secondary combustion air supply means including a secondary air supply manifold within the combustion chamber above the primary combustion air supply manifold;

secondary air control means independent of the primary air control means for selectively allowing entry of secondary air from outside the enclosure to an area within the combustion chamber above the retort;

an exhaust duct opening into the enclosure; and vacuum means connected to the exhaust duct for producing a pressure differential between the area confined by the enclosure and the ambient atmosphere such that ambient air is drawn through at least one of the combustion air supply means to induce a high level of gasification and to support combustion at the retort and for drawing combustion exhaust gases out through the exhaust duct;

wherein the primary combustion air supply manifold is integral with the retort at the upper end thereof;

wherein the primary air supply manifold extends about the periphery of the upper open end of the retort and includes a primary air discharge opening formed therein facing inwardly across the upper retort end; and wherein the primary air supply manifold includes spaced horizontal top and bottom peripheral edges and wherein the primary air discharge opening is situated toward the bottom peripheral edge.

2. The combustible particulate fired heater as claimed by claim 1 further comprising:

a hopper mounted to the airtight enclosure for receiving and delivering particulate fuel to the feed conveyor means; and insulation means between the airtight enclosure and hopper for thermally insulating the hopper from the enclosure.

3. The combustible particulate fired heater as claimed by claim 2 wherein the insulation means is comprised of an airspace between the hopper and combustion chamber.

4. The combustible particulate fired heater as claimed by claim 3 wherein the airspace is an integral part of a heat exchanger plenum partially surrounding the enclosure, and further comprising blower means for forcing ambient air through the heat exchanger plenum.

5. The combustible particulate fired heater as claimed by claim 1 wherein the exhaust duct is located elevationally below the open top end of the combustion chamber.

6. The combustible particulate fired heater as claimed by claim 5 wherein the vacuum means is comprised of a powered blower, having an intake connected to the exhaust duct.

7. The combustible particulate fired heater as claimed by claim 1 wherein the feed conveyor means is comprised of a powered auger feed leading into the airtight enclosure to a discharge end adjacent the bottom end of the combustion chamber; and wherein the retort is upright with its lower end mounted to the discharge end of the auger feed, and its upper open end adjacent to the bottom end of the combustion chamber.

8. The combustible particulate fired heater as claimed by claim 1 wherein the secondary air supply manifold surrounds an area overlying the primary air supply manifold and includes a secondary air discharge opening facing inwardly across the area encompassed thereby.

9. The combustible particulate fired heater as claimed by claim 1 further comprising a water jacket heat exchanger adjacent the combustion chamber, having a cold water inlet adjacent the bottom end of the combustion chamber and a hot water discharge elevationally above the cold water inlet.

10. The combustible particulate fired heater as claimed by claim 9 further comprising an exhaust gas plenum disposed between the water jacket and combustion chamber and having:

a closed top end spaced above the combustion chamber top end;

upright side walls spaced outwardly of the combustion chamber and extending from the closed top end to a bottom exhaust gas plenum end adjacent the combustion chamber bottom end; and wherein the exhaust duct opens into the exhaust gas plenum adjacent the bottom exhaust gas plenum end.

11. The combustible particulate fired heater as claimed by claim 1 further comprising:

a heat exchanger within the enclosure;

an exhaust gas plenum disposed between the heat exchanger and combustion chamber and having:

a closed top end spaced above the combustion chamber top end;

upright side walls spaced outwardly of the combustion chamber and extending from the closed top end to a bottom exhaust gas plenum end adjacent the combustion chamber bottom end; and wherein the exhaust duct opens into the exhaust gas plenum adjacent the bottom exhaust gas plenum end.

12. A combustible particulate fired heater, comprising:

an enclosure;

a combustion chamber within the enclosure having open top and bottom ends defined by upright side walls;

an exhaust plenum within the enclosure, partially encasing the combustion chamber and having walls spaced outwardly of the combustion chamber walls to define an exhaust gas passage leading from the open top end of the chamber toward the chamber bottom; and an exhaust duct opening into the exhaust plenum adjacent the bottom end of the combustion chamber and leading outside the enclosure;

vacuum means on the exhaust duct for producing a partial vacuum within the combustion chamber and exhaust plenum;

retort means having an open top end and a bottom end within the combustion chamber adjacent the bottom end thereof for receiving combustible particulate fuel;

means for supplying particulate fuel to the retort means through the bottom end thereof;

primary combustion air supply means including an air manifold within the combustion chamber with openings leading into the retort below the top end thereof, said manifold leading to a primary air intake control outside the enclosure, for selectively admitting primary air into the combustion chamber in response to the partial vacuum formed therein by the vacuum means and a secondary combustion air supply means including a secondary air manifold spaced above the primary combustion air supply means encompassing an area directly over and spanning the open top end of the retort means and leading to an air intake outside the enclosure separate from the air intake of the primary air supply means, a secondary air intake control for selectively admitting secondary air into the combustion chamber in response to the partial vacuum formed therein by the vacuum means.

13. The combustible particulate fired heater as claimed by claim 12 wherein the combustion air manifold is annular, extending about the retort and having openings therein facing one another across the retort to deliver air to particulate fuel therein.

* * * * *